US008857502B2

(12) United States Patent
Huang

(10) Patent No.: US 8,857,502 B2
(45) Date of Patent: Oct. 14, 2014

(54) VAPOR CHAMBER HAVING HEATED PROTRUSION

(75) Inventor: Yu-Po Huang, Kunshan (CN)

(73) Assignee: Kunshan Jue-Chung Electronics Co., Ltd., Kunshan, Jiangsu (CN)

( * ) Notice: Subject to any disclaimer, the term of this patent is extended or adjusted under 35 U.S.C. 154(b) by 541 days.

(21) Appl. No.: 13/191,005

(22) Filed: Jul. 26, 2011

(65) Prior Publication Data

US 2013/0025829 A1 Jan. 31, 2013

(51) Int. Cl.
*F28D 15/04* (2006.01)
*F28D 15/02* (2006.01)

(52) U.S. Cl.
CPC ..... *F28D 15/0233* (2013.01); *F28D 15/046* (2013.01)
USPC ..... 165/104.26; 361/700

(58) Field of Classification Search
USPC ..... 165/80.2, 80.3, 80.5, 104.26, 104.33
See application file for complete search history.

(56) References Cited

U.S. PATENT DOCUMENTS 6,082,443 A * 7/2000 Yamamoto et al. ..... 165/104.26
6,901,994 B1 * 6/2005 Jin-Cherng et al. ..... 165/104.26
7,543,629 B2 * 6/2009 Chin et al. ..... 165/104.21
7,609,520 B2 * 10/2009 Chang et al. ..... 361/700
2008/0283222 A1 * 11/2008 Chang et al. ..... 165/104.26
2009/0025910 A1 * 1/2009 Hoffman et al. ..... 165/104.26
2009/0166005 A1 * 7/2009 Lai et al. ..... 165/104.26
2009/0294104 A1 * 12/2009 Lin et al. ..... 165/104.26

* cited by examiner

*Primary Examiner* — Allen Flanigan

(74) *Attorney, Agent, or Firm* — Chun-Ming Shih; HDLS IPR Services

(57) ABSTRACT

A vapor chamber is configured to conduct heat generated by a heat-generating element and includes a bottom plate, a first wick structure, a second wick structure, a cover plate and a working fluid filled between the cover plate and the bottom plate. One side of the bottom plate has a heated protrusion in thermal contact with the heat-generating element, and the other side is formed with an accommodating trough corresponding to the heated protrusion. The first wick structure is provided in the accommodating trough. The second wick structure is disposed on the bottom plate and provided with an opening and a plurality of airflow channels in communication with the opening. The cover plate tightly covers the bottom plate. The supporting posts are sandwiched between the cover plate and the first wick structure. By this arrangement, the mounting and heat-conducting of the heat-generating element can be achieved.

8 Claims, 9 Drawing Sheets

VAPOR CHAMBER HAVING HEATED PROTRUSION

BACKGROUND OF THE INVENTION

1. Field of the Invention

The present invention relates to a vapor chamber, and in particular to a vapor chamber having a heated protrusion.

2. Description of Prior Art

A vapor chamber is a heat-conducting module that is widely used, which includes a flat casing, a working fluid filled in the flat casing, a wick structure formed on inner walls of the flat casing, and a supporting structure provided inside the flat casing. The supporting structure provides a sufficient strength to the flat casing to withstand external pressures, thereby protecting the flat casing from recessing due to the external pressures. In use, one surface of the vapor chamber contacting a heat-generating element is called as a heat-absorbing surface, and the other surface of the vapor chamber away from the heat-generating element is called as a heat-releasing surface. A portion of the working fluid in the vapor chamber adjacent to the heat-absorbing surface absorbs the heat generated by the heat-generating element to become vapor. The vapor-phase working fluid flows toward the heat-releasing surface on which it condenses to flow back to the heat-absorbing surface along the wick structure. With the vapor/liquid phase change and circulation of the working fluid in the wick structure, the heat generated by the heat-generating element can be conducted to the outside.

The inner walls of the vapor chamber are provided with the wick structure. The whole heat-absorbing surface can be used for conducting the heat. However, not the whole heat-absorbing surface is brought into thermal contact with the heat-generating element. Thus, a portion of the wick structure on the inner wall of the heat-absorbing surface not contacting the heat-generating element does not contribute to the heat conduction a lot. In other words, the remaining wick structure inevitably increases the production cost of the vapor chamber. If the wick structure could be concentrated on the heat-absorbing surface at a position corresponding to the heat-generating element, the efficiency of the wick structure will be increased and the production cost can be reduced.

On the other hand, with the advancement of science and technology, a plurality of heat-generating elements are arranged on a large printed circuit board. Since the thickness of each heat-generating element is different, the conventional vapor chamber having a flat heat-absorbing surface cannot surely contact every heat-generating element. As a result, several vapor chambers have to be disposed on the printed circuit board to correspond to the respective heat-generating element, which increases the production cost. Further, mounting these vapor chambers on the printed circuit board involves more steps.

Therefore, it is an important issue for the present Inventor to solve the above-mentioned problems.

SUMMARY OF THE INVENTION

The present invention is to provide a vapor chamber having a heated protrusion, in which a portion of the vapor chamber not contacting a heat-generating element is raised to facilitate the mounting and heat-dissipating of a heat-generating element.

The present invention is to provide a vapor chamber having a heated protrusion, in which a wick structure is provided at a position corresponding to the heat-generating element. By this arrangement, the heat-conducting efficiency of the wick structure is increased and the cost is reduced.

The present invention provides a vapor chamber configured to conduct heat generated by a heat-generating element and including:

a bottom plate, one side of the bottom plate having at least one heated protrusion brought into thermal contact with the heat-generating element, the other side thereof being formed with an accommodating trough corresponding to the heated protrusion;

a first wick structure provided in the accommodating trough;

a second wick structure disposed on the bottom plate, the second wick structure being provided with an opening corresponding to the accommodating trough and a plurality of airflow channels in communication with the opening;

a cover plate tightly covering the bottom plate;

a plurality of supporting posts located in the accommodating trough and sandwiched between the cover plate and the first wick structure; and a working fluid filled between the cover plate and the bottom plate.

In comparison with prior art, the present invention has advantageous features as follows.

Since one side of the bottom plate has at least one heated protrusion brought into thermal contact with the heat-generating element, the peripheral dimension and thickness of the heated protrusion can be designed based on the peripheral dimension and thickness of the heat-generating element. In this way, the vapor chamber is formed with a plurality of heated protrusions of different thickness for conducting the heat generated by a plurality of heat-generating elements on a printed circuit board.

Since the other side of the bottom plate is formed with the accommodating trough corresponding to the heated protrusion, and the first wick structure is disposed in the accommodating trough, the size of the first wick structure can be controlled based on the peripheral dimension of the heat-generating element. Thus, the efficiency of the first wick structure is enhanced greatly, and the production cost is reduced.

Since the second wick structure has an opening corresponding to the accommodating trough and a plurality of airflow channels in communication with the opening, the vapor-phase working fluid in the first wick structure can rapidly flow through the opening and the airflow channels toward the cover plate, thereby conducting the heat generated by the heat-generating element to the cover plate rapidly.

Since the cover plate is formed with a plurality of supporting posts, and the second wick structure is provided between the cover plate and the bottom plate, the vapor-phase working fluid flowing toward the cover plate condenses on the cover plate, and then the condensed working fluid rapidly flows back to the first wick structure via the second wick structure and the supporting posts, thereby preventing the dry-out of the working fluid in the first wick structure and increasing the heat-conducting effect of the vapor chamber.

The bottom plate has an accommodating trough. The cover plate is formed with a plurality of supporting posts at a position corresponding to the accommodating trough. The supporting posts are configured to connect and support between the cover plate and the first wick structure. Thus, the supporting posts serve as a path for allowing the vapor-phase working fluid to flow back to the first wick structure. Further, the supporting posts provide a sufficient strength between the cover plate and the first wick structure, thereby preventing the cover plate from recessing into the accommodating trough.

DETAILED DESCRIPTION OF THE INVENTION

Figure 1:
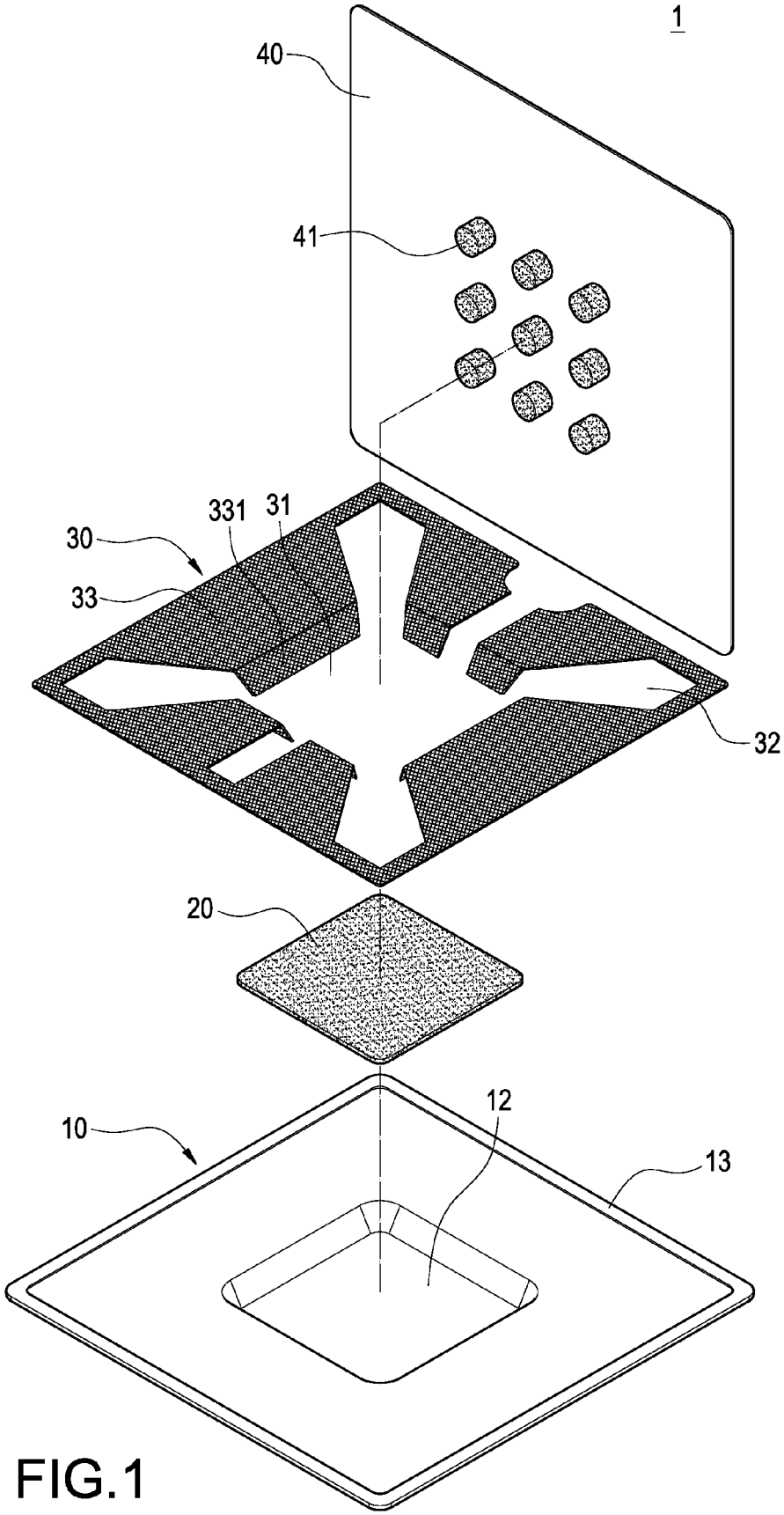
FIG. 1 is an exploded perspective view of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 5. The present invention relates to a vapor chamber 1 having a heated protrusion, which is configured to conduct heat of a heat-generating element 100. The vapor chamber 1 includes a bottom plate 10, a first wick structure 20, a second wick structure 30, a cover plate 40 and a working fluid 50.

Figure 2:
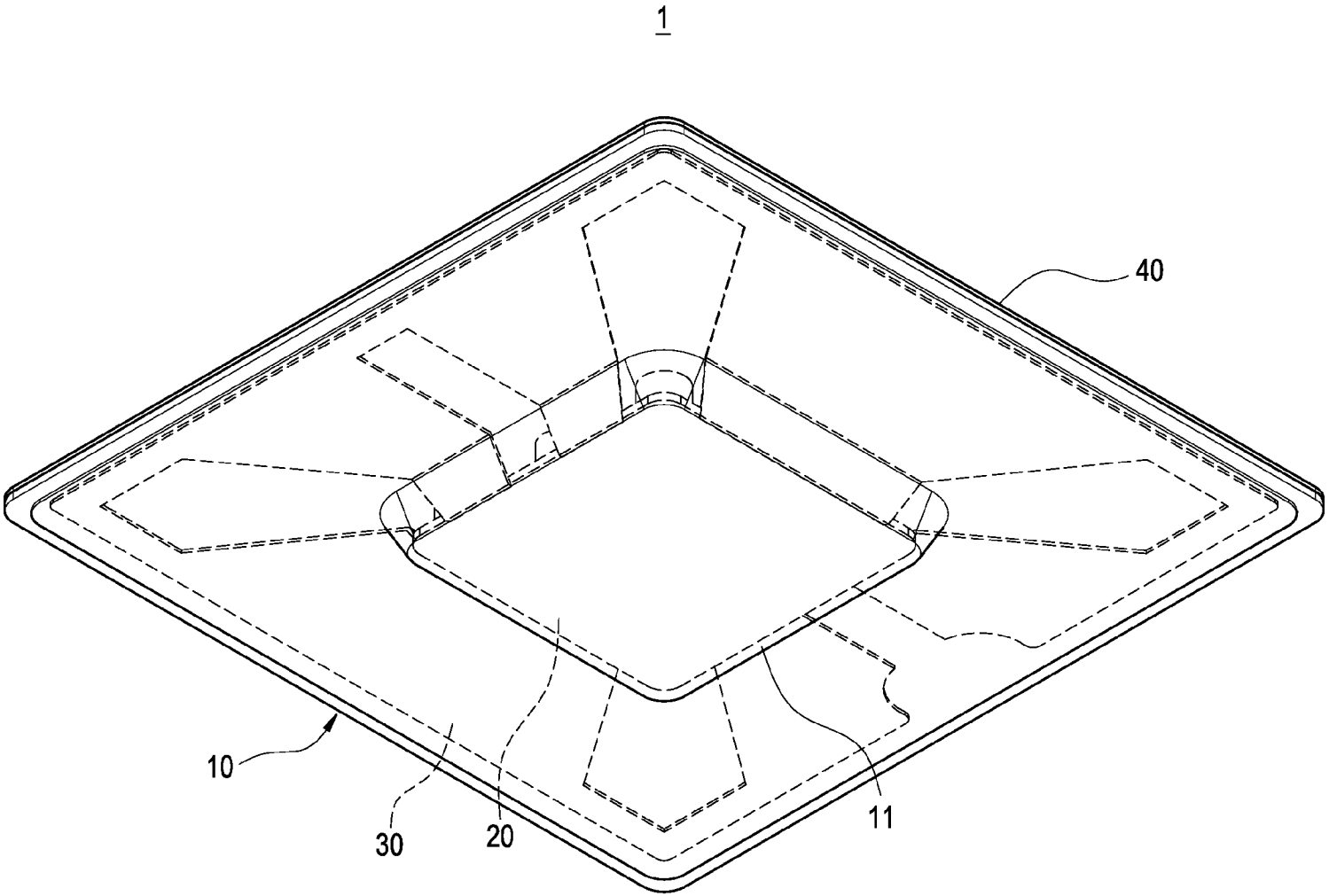
FIG. 2 is an assembled perspective view of the present invention.
Figure 3:
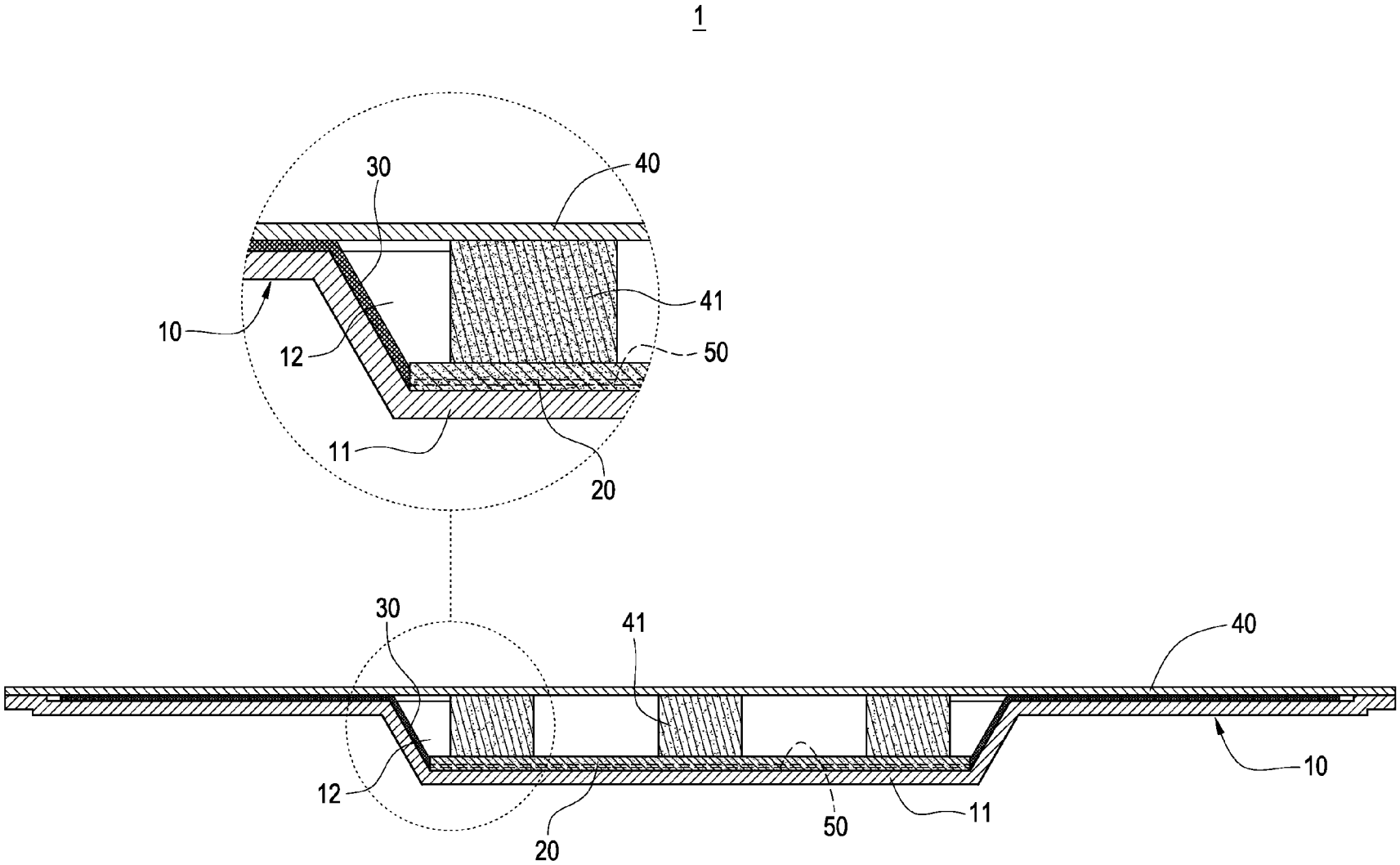
FIG. 3 is a side cross-sectional view of the present invention.

The bottom plate 10 is made of metallic material. One side of the bottom plate 10 has a heated protrusion 11 brought into thermal contact with the heat-generating element 100 (as shown in FIG. 2). The other side of the bottom plate 10 is formed with an accommodating trough 12 corresponding to the heated protrusion 11. As shown in FIGS. 1 and 2, the heated protrusion 11 is formed into a square shape, and the accommodating trough 12 is also formed into a square shape. However, the shape of the heated protrusion 11 and the accommodating trough 12 are not limited thereto, and can be changed based on the peripheral dimension of the heat-generating element 100.

The first wick structure 20 is provided in the accommodating trough 12. The first wick structure 20 is shaped as a plate to be flatly disposed in the bottom of the accommodating trough 12. By this arrangement, the heat generated by the heat-generating element 100 can be conducted to the accommodating trough 12 via the heated protrusion 11 of the bottom plate 10 and absorbed by the working fluid 50 in the first wick structure 20. The first wick structure 20 is an element made of sintered metal powder or metal woven mesh. However, the first wick structure 20 made of sintered metal power has a larger density.

Figure 9:
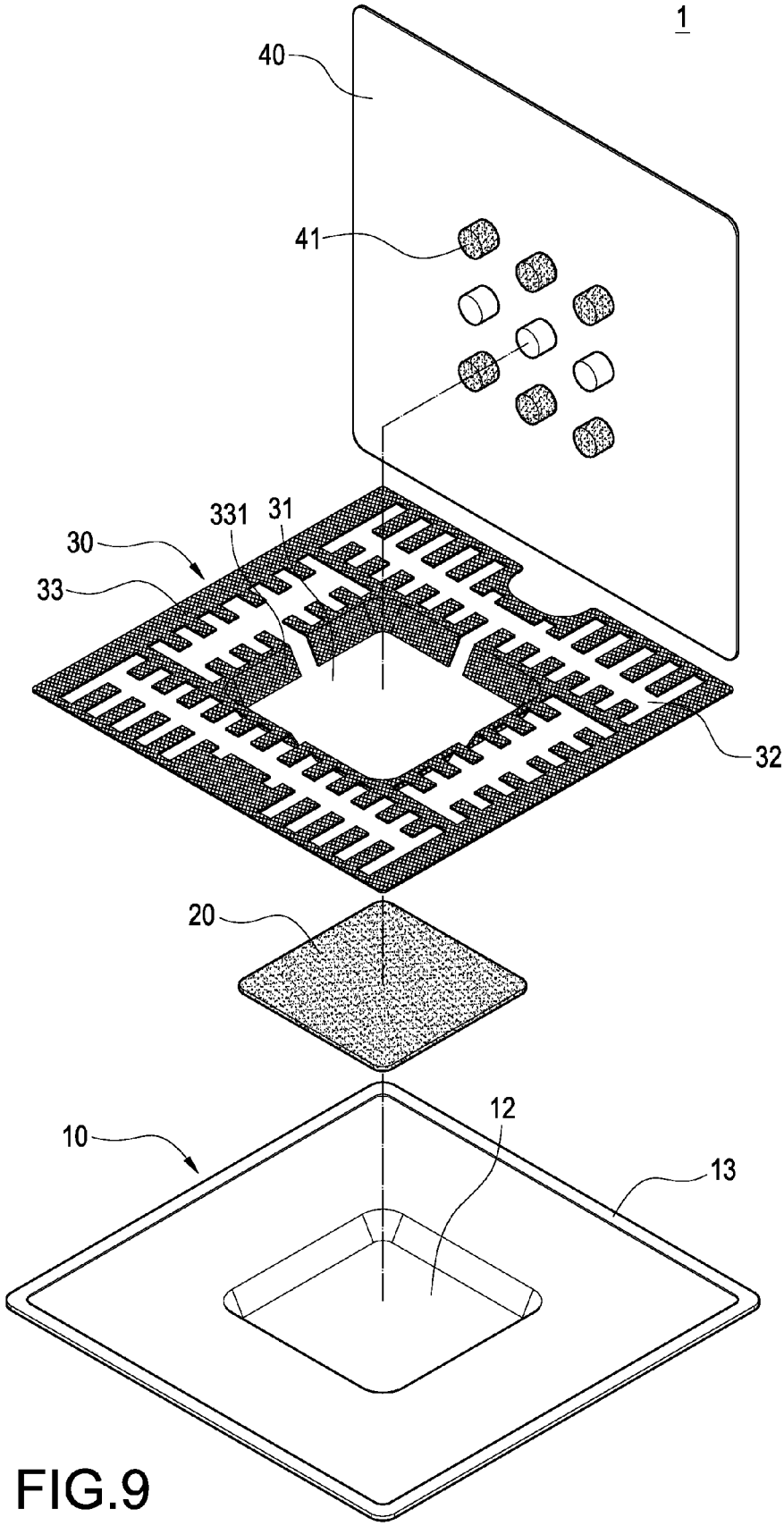
FIG. 9 is an exploded perspective view showing a further embodiment of the present invention.

The periphery of one surface of the bottom plate 10 on the same side as the accommodating trough 12 is formed with a flange 13. The thickness of the flange 13 is substantially the same as the thickness of the second wick structure 30, so that the second wick structure 30 can be flatly disposed on the bottom plate 10. The second wick structure 20 is made of metal woven mesh. The second wick structure 30 has an opening 31 corresponding to the accommodating trough 12 and a plurality of airflow channels 32 in communication with the opening 31. More specifically, the second wick structure 30 is shaped as a plate to be adhered to the bottom plate 10. The center of the second wick structure 30 is provided with an opening 31 corresponding to the accommodating trough 12. The periphery of the opening 31 is arranged with a plurality of wick pieces 33. An airflow channel 32 is formed between any two adjacent wick pieces 33. Thus, the airflow channels 32 are arranged to surround the opening 31. Similarly, the airflow channels 32 may be cross-linked to form cross-shaped channels as shown in FIG. 9. By this arrangement, the vapor-phase working fluid 50 can spread to all directions from the opening 31 via the airflow channels 32.

It should be noted that, the distal end of each wick piece 33 adjacent to the opening 31 is bent into a guiding section 331 toward the first wick structure 20. By this arrangement, the condensed working fluid 50 can rapidly flow into the first wick structure 20 in the accommodating trough 12 via the wick pieces 33 of the second wick structure 30 along the guiding sections 331, thereby preventing the dry-out of the working fluid 50 in the first wick structure 20.

The cover plate 40 is made of metallic materials and tightly covers the bottom plate 10. The profile of the cover plate 40 corresponds to the profile of the bottom plate 10. In this way, between the cover plate 40 and the bottom plate 10, a sealing space is generated, in which the liquid/vapor phase change and circulation of the working fluid 50 occur. The cover plate 40 is formed with a plurality of supporting posts 41 at positions corresponding to the accommodating trough 12. The supporting posts 41 may be made of sintered metal powder, metallic posts (as shown in FIG. 9) or the mixture thereof, thereby generating a better supporting effect. The supporting posts 41 are sandwiched between the cover plate 40 and the first wick structure 20, thereby protecting the cover plate 40 from recessing into the accommodating trough 12. The supporting posts 41 are made respectively and then connected onto the inner wall of the cover plate 40 or the surface of the first wick structure 20.

The working fluid 50 is filled between the cover plate 40 and the bottom plate 10. The liquid-phase working fluid 50 is naturally collected in the accommodating trough 12 and enters the first wick structure 20 due to gravity force.

Figure 4:
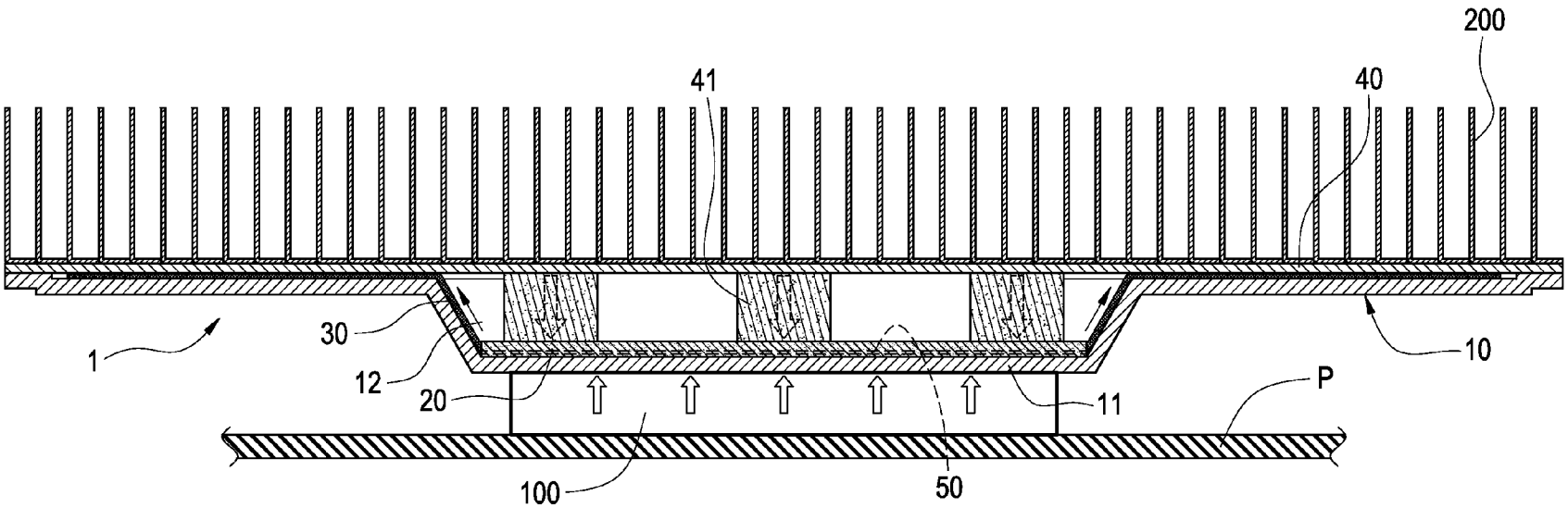
FIG. 4 is a schematic view showing the operation of the present invention.
Figure 5:
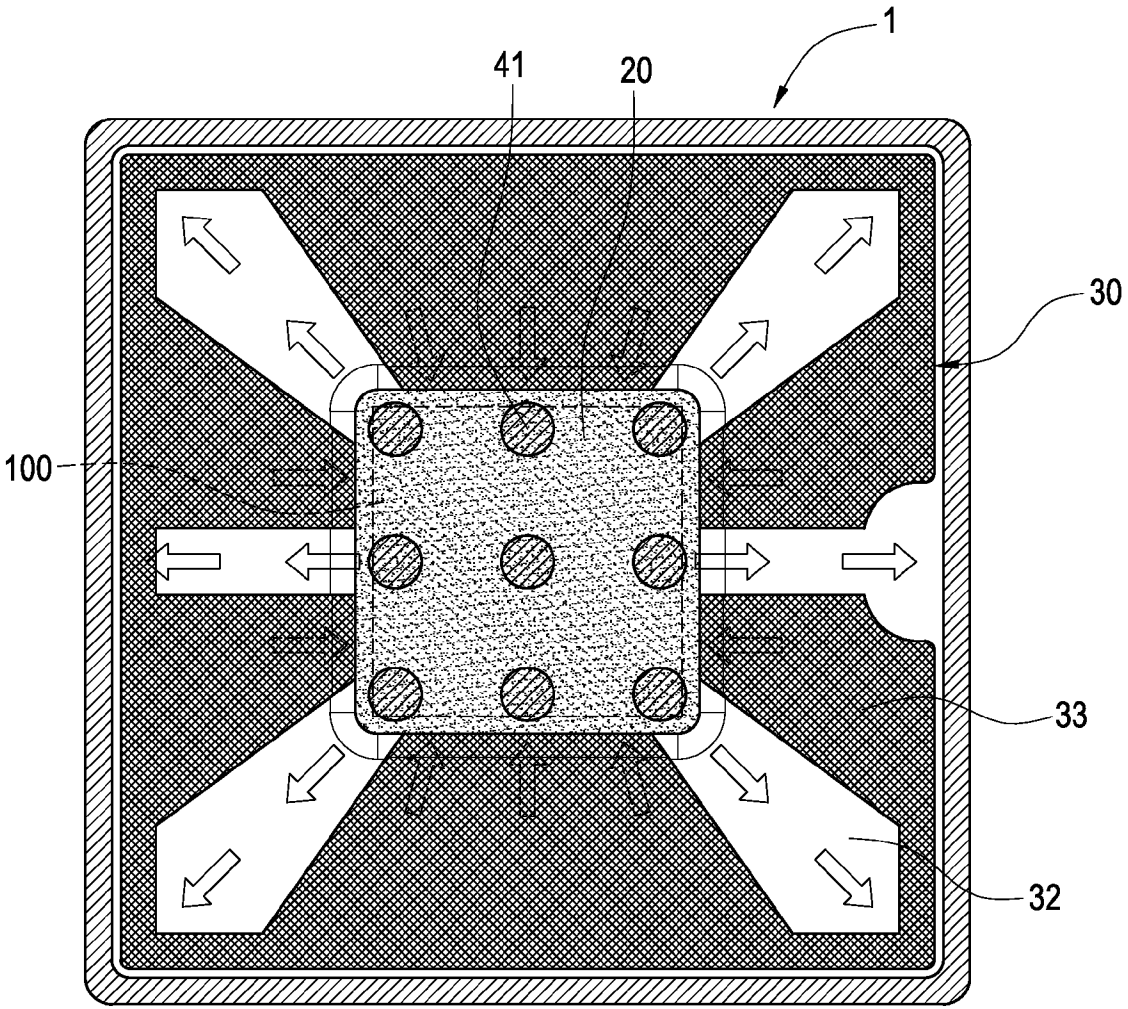
FIG. 5 is a top view of the present invention showing the flow of the working fluid.

Please refer to FIGS. 4 and 5. When the vapor chamber 1 of the present invention is disposed on the heat-generating element 100 of a printed circuit board P, the heated protrusion 11 is brought into thermal contact with the heat-generating element 100 to absorb the heat generated by the heat-generating element 100. The heat absorbed by the heated protrusion 11 is conducted through the bottom plate 10 to enter the accommodating trough 12, so that the working fluid 50 in the first wick structure 20 disposed in the accommodating trough 12 evaporates and flows to the cover plate 40 along the airflow channels 32 (as shown in FIG. 5). The cover plate 40 is connected to a heat-dissipating fin set 200 for dissipating the heat in the cover plate 40 to the outside. After releasing the latent heat, the working fluid 50 condenses and flows back to the first wick structure 20 along the wick pieces 33 (as shown in FIG. 5) of the second wick structure 30 and the supporting posts 41 (as shown in FIG. 4).

Figure 6:
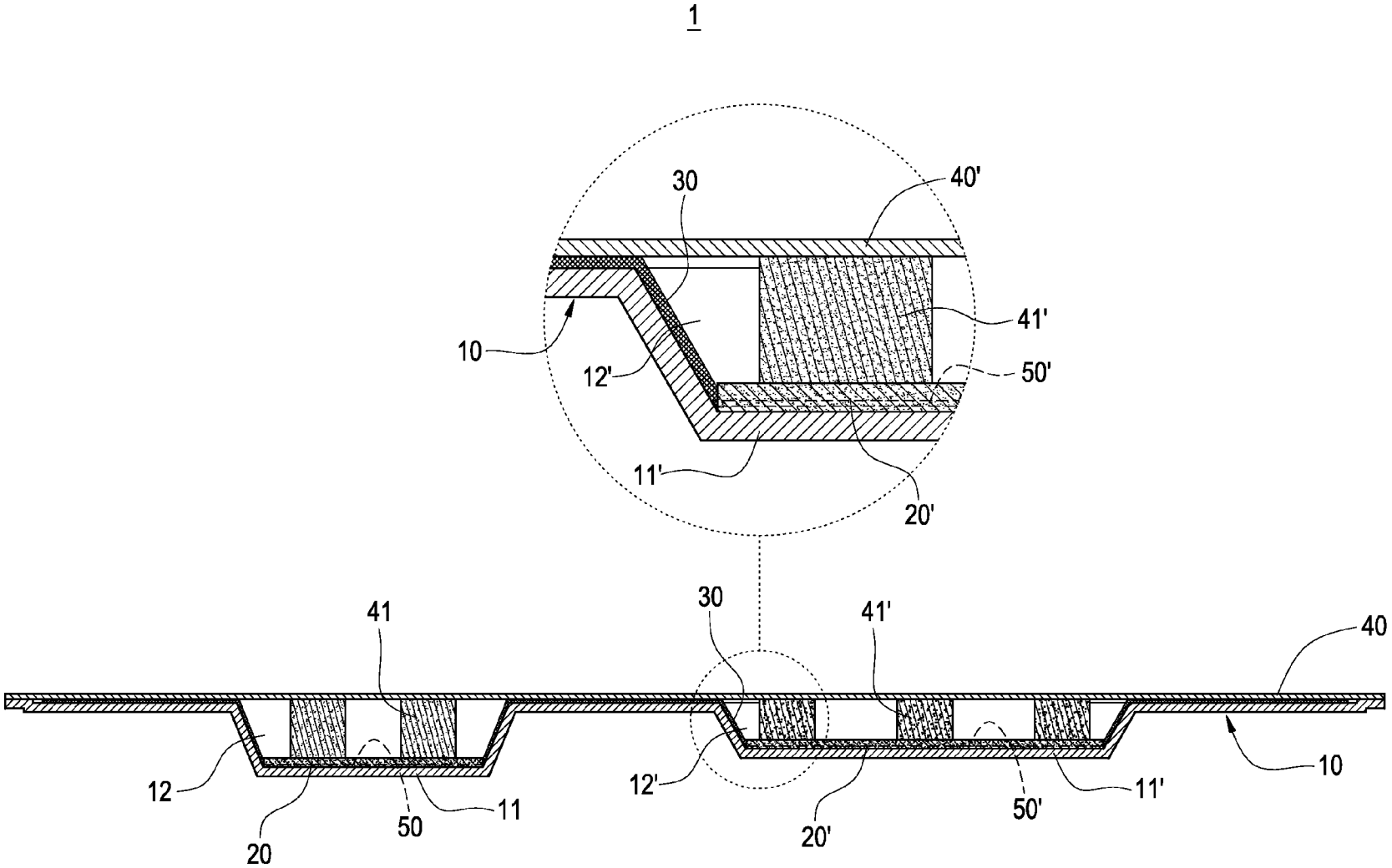
FIG. 6 is a side cross-sectional view showing another embodiment of the present invention.
Figure 7:
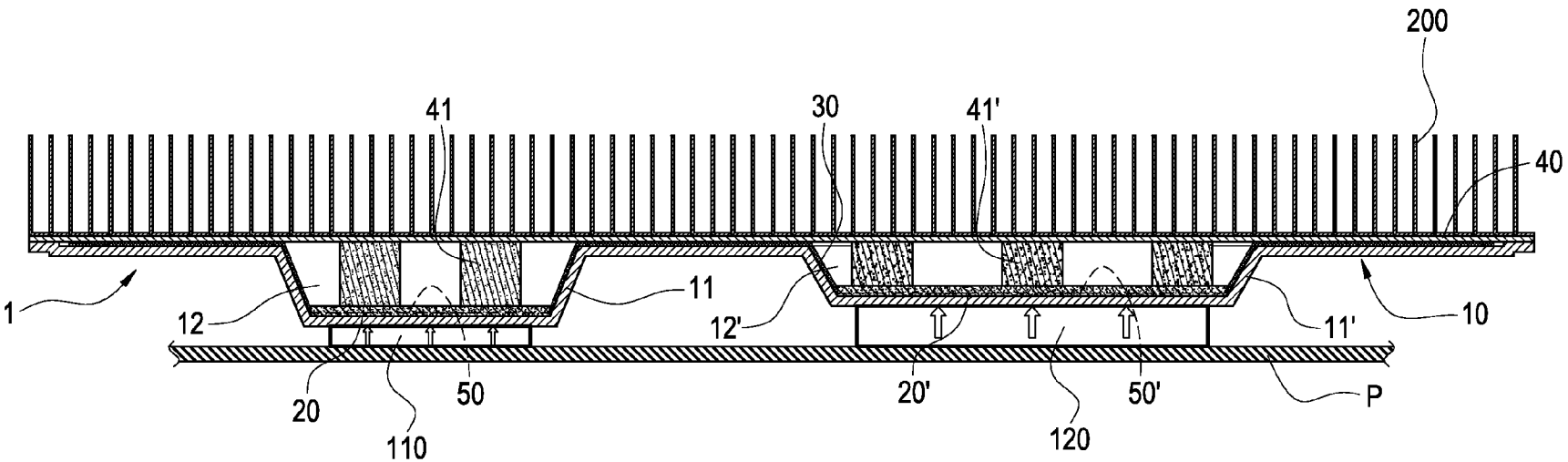
FIG. 7 is a schematic view showing the operation of another embodiment of the present invention.
Figure 8:
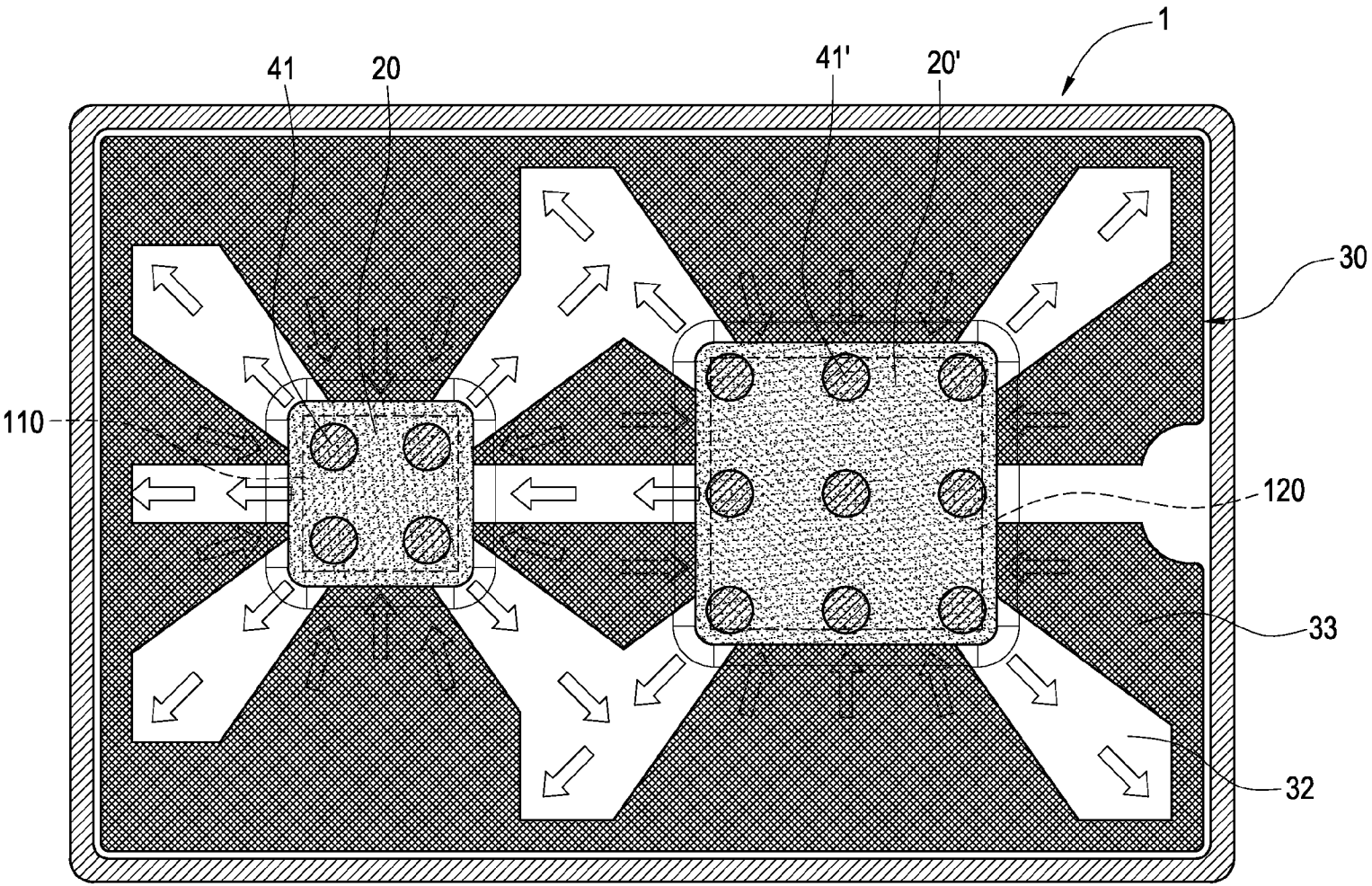
FIG. 8 is a top view of another embodiment of the present invention showing the flow of the working fluid.

Please refer to FIGS. 6 to 8, which show another embodiment of the present invention. The different between the present embodiment and the previous embodiment lies in that: two heated protrusions 11, 11' are provided on the bottom plate 10 to correspond to two heat-generating elements 110, 120 respectively. However, the number of the heated protrusion 11 is not limited to one or two. The number, location and thickness of each heated protrusion 11 can be designed based on the number, location and thickness of the respective heat-generating elements.

The vapor chamber 1 of the present embodiment also includes the bottom plate 10, the first wick structure 20, the second wick structure 30, the cover plate 40, the supporting posts 41 and the working fluid 50. The same description of the present embodiment as that of the previous embodiment is omitted for simplicity.

As shown in FIGS. 6 and 7, the peripheral dimension and thickness of the heated protrusion can be changed based on the peripheral dimension and thickness of the heat-generating element. More specifically, a first heat-generating element 110 and a second heat-generating element 120 are provided on the printed circuit board P. The peripheral dimension and thickness of the first heat-generating element 110 are smaller than those of the second heat-generating element 120. Thus, the bottom plate 10 is formed with a first heated protrusion 11 and a second heated protrusion 11'. The location and peripheral dimension of the first heated protrusion 11 correspond to those of the first heat-generating element 110. The location and peripheral dimension of the second heated protrusion 11' correspond to those of the second heat-generating element 120. However, the protruding distance of the first heated protrusion 11 from the bottom plate 10 is larger than the protruding distance of the second heated protrusion 11' from the bottom plate 10. In other words, the sum of the protruding distance of the first heated protrusion 11 from the bottom plate 10 and the thickness of the first heat-generating element 110 is equal to the sum of the protruding distance of the second heated protrusion 11' from the bottom plate 10 and the thickness of the second heat-generating element 120. By this arrangement, the distance between the printed circuit board P and the cover plate 40 of the vapor chamber 1 can be kept the same.

The first wick structure 20 is disposed in the accommodating trough 12 on the opposite side of the first heated protrusion 11. The cover plate 40 is formed with supporting posts 41 corresponding to the first wick structure 20. The first wick structure 20' is disposed in the accommodating trough 12' on the opposite side of the second heated protrusion 11'. The cover plate 40 is formed with supporting posts 41' corresponding to the first wick structure 20'. The second wick structure 30 is formed with two openings (as shown in FIG. 8) corresponding to the accommodating troughs 12, 12' and a plurality of airflow channels 32 in communication with the two openings.

Please refer to FIGS. 7 and 8. When the vapor chamber 1 of the present invention is disposed on the printed circuit board P in such a manner that the first heated protrusion 11 is brought into thermal contact with the first heat-generating element 110 to absorb the heat generated by the first heat-generating element 110, the heat absorbed by the first heated protrusion 11 is conducted through the bottom plate 10 to enter the accommodating trough 12, so that the working fluid 50 in the first wick structure 20 disposed in the accommodating trough 12 evaporates and flows to the cover plate 40 along the airflow channels 32. The cover plate 40 is connected to a heat-dissipating fin set 200 for dissipating the heat in the cover plate 40 to the outside. After releasing the latent heat, the working fluid 50 condenses and flows back to the first wick structure 20 along the second wick structure 30 (as shown in FIG. 8) and the supporting posts 41 (as shown in FIG. 7).

Similarly, the second heated protrusion 11' is brought into thermal contact with the second heat-generating element 120 to absorb the heat generated by the second heat-generating element 120. The heat absorbed by the second heated protrusion 11' is conducted through the bottom plate 10 to enter the accommodating trough 12', so that the working fluid 50' in the first wick structure 20' disposed in the accommodating trough 12' evaporates and flows to the cover plate 40 along the airflow channels 32. The cover plate 40 is connected to a heat-dissipating fin set 200 for dissipating the heat in the cover plate 40 to the outside. After releasing the latent heat, the working fluid 50' condenses and flows back to the first wick structure 20' along the second wick structure 30 (as shown in FIG. 8) and the supporting posts 41' (as shown in FIG. 7).

In this way, the vapor chamber 1 rapidly conducts the heat generated by the first heat-generating element 110 and the second heat-generating element 120 to heat-dissipating fin set 200, thereby dissipating the heat to the outside.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A vapor chamber configured to conduct heat generated by a heat-generating element and including:

a bottom plate, one side of the bottom plate having at least one heated protrusion brought into thermal contact with the heat-generating element, the other side thereof being formed with an accommodating trough corresponding to the heated protrusion and a first flat surface surrounding the accommodating trough, wherein a flange is formed on a periphery of the first flat surface;

a first wick structure provided in the accommodating trough, the first wick structure is shaped as a plate to be flatly disposed on a bottom surface of the accommodating trough;

a second wick structure disposed on the first flat surface of the bottom plate, having an opening corresponding to the accommodating trough, a plurality of wick pieces arranged at intervals surrounding the opening, a guiding section extending from a distal end of each wick piece adjacent to the opening bent toward the first wick structure to dispose on a wall surface of the accommodating trough, and an of airflow channel in communication with the opening formed between any two adjacent wick pieces;

a cover plate tightly covering the bottom plate, having a second flat surface facing to the first flat surface and the accommodating trough, and the flange is configured to allow the wick pieces to be flatly sandwiched between the first flat surface and the second flat surface;

a plurality of supporting posts located in the accommodating trough and sandwiched between the cover plate and the first wick structure; and a working fluid filled between the cover plate and the bottom plate.

2. The vapor chamber according to claim 1, wherein the first wick structure is an element made of sintered metal powder or metallic woven mesh.

3. The vapor chamber according to claim 1, wherein the second wick structure is a metallic woven mesh, and the airflow channels are arranged to surround the opening.

4. The vapor chamber according to claim 1, wherein the second wick structure is a metallic woven mesh, and the airflow channels are cross-linked to form cross-shaped channels.

5. The vapor chamber according to claim 1, wherein each of the supporting posts is an element made of sintered metal powder.

6. The vapor chamber according to claim 1, wherein each of the supporting posts is a metallic post.

7. The vapor chamber according to claim 1, wherein some supporting posts are made of sintered metal powder, and the others are metallic posts.

8. The vapor chamber according to claim 1, wherein the heat-generating element comprises a first heat-generating element and a second heat-generating element, the bottom plate is formed with a first heated protrusion at a position corresponding to the first heat-generating element, and the bottom plate is formed with a second heated protrusion at a position corresponding to the second heat-generating element.

* * * * *